US007624612B2

(12) United States Patent
Toda et al.

(10) Patent No.: US 7,624,612 B2
(45) Date of Patent: Dec. 1, 2009

(54) DEVICE FOR ADJUSTING ANGLE OF GOLF CLUB SHAFT

(75) Inventors: Haruhisa Toda, Seto (JP); Yukio Tani, Kasugai (JP); Katsunori Yoshida, Kasugai (JP)

(73) Assignee: Japana Co., Ltd., Nagoya (JP)

( * ) Notice: Subject to any disclaimer, the term of this patent is extended or adjusted under 35 U.S.C. 154(b) by 0 days.

(21) Appl. No.: 11/943,560

(22) Filed: Nov. 20, 2007

(65) Prior Publication Data

US 2008/0202193 A1 Aug. 28, 2008

(30) Foreign Application Priority Data

Nov. 21, 2006 (JP) ..... 2006-314365

(51) Int. Cl.
*B21D 7/022* (2006.01)

(52) U.S. Cl. ..... 72/390.6; 72/389.1; 72/389.2; 72/389.8; 72/418

(58) Field of Classification Search ..... 72/293, 72/389.1, 389.2, 389.8, 418, 458, 459, 479, 72/390.6

See application file for complete search history.

(56) References Cited

U.S. PATENT DOCUMENTS 3,034,385 A * 5/1962 Woodrow ..... 72/389.1
3,124,192 A * 3/1964 Williams et al. ..... 72/389.8
3,357,219 A * 12/1967 Hunter ..... 72/459
3,965,714 A * 6/1976 Beard ..... 72/418
4,055,069 A * 10/1977 Caporusso et al. ..... 72/389.8
4,245,391 A * 1/1981 Heller ..... 72/293
4,245,392 A * 1/1981 Heller ..... 72/293
4,299,113 A * 11/1981 Belotti ..... 72/389.8
4,640,017 A * 2/1987 Cukon ..... 72/293
5,615,572 A * 4/1997 Johnson et al. ..... 72/389.1
5,761,950 A * 6/1998 Chiu ..... 72/389.1
7,310,987 B1 * 12/2007 Rupert ..... 72/389.1

* cited by examiner

*Primary Examiner*—David B Jones
(74) *Attorney, Agent, or Firm*—Hiroe & Associates; Taras P. Bemko

(57) ABSTRACT

An angle adjuster for a golf club shaft includes a pressing part that can advance and retreat towards and away from a space between two pressing force receiving parts. The pressing force receiving parts include grooves configured to receive a golf club shaft. When the pressing part is advanced against the golf club shaft, a bending force is applied to the shaft at a bending location on the shaft that lies between the pressing force receiving parts. This occurs while the shaft is received in, the receiving grooves of the pressing force receiving parts.

17 Claims, 9 Drawing Sheets

DEVICE FOR ADJUSTING ANGLE OF GOLF CLUB SHAFT

BACKGROUND OF THE INVENTION

The present invention relates to an angle adjuster for adjusting the bending angle of the bent part of a golf club shaft.

FIGS. 10 and 11 show a prior art angle adjuster for adjusting the bending angle of the bent part of a golf club shaft. As shown in FIG. 10, the angle adjuster includes a clamp part 102, which clamps and sets the golf club head 101, and a bending bar 103, which adjusts the bending angle of the golf club shaft G on which the golf club head 101 is set by said clamp part 102.

The clamp part 102 is equipped with horizontal positioning parts 104 and a pressing part 105. The horizontal positioning parts 104 are provided in a pair such that they face one another, and the golf club head 101 is interposed between this pair of horizontal positioning parts 104, 104 and positioning in horizontal direction is done. In addition, the pressing part 105 is provided such that it is in contact with the upper surface of the golf club head 101.

As shown in FIG. 11, this is a configuration wherein the above-mentioned bending bar 103 is formed in roughly a T-shape from a gripping bar 106 and an operating bar 107 that is provided on the tip of said gripping bar 106, and columnar contact parts 108 and 109 are provided on both ends of said operating bar 107.

The bending angle of the golf club shaft G is first adjusted with an angle adjuster 100 configured as shown in FIG. 10. Positioning of the golf club shaft G in a horizontal direction is then carried out by clamping and holding the golf club head 101 with the pair of horizontal positioning parts 104. Next, the position of the golf club shaft is fixed by pressing downwards the upper surface of the golf club head 101 with the pressing part 105.

Next, as FIG. 11 illustrates, the two contact parts 108 and 109 of the bending bar 103 are brought into contact with the golf club shaft G, by positioning the golf club shaft G between the two contact parts 108 and 109 of the bending bar 103. After that, the operator grips the base end side of the gripping part 106 of the bending bar 103, pushes the lower side contact part 109 forwards (in FIG. 11, in the direction of arrow A), and pulls the upper contact part 108 in the opposite direction (in FIG. 11, in the direction of arrow B), and pushes the base end side of said bending bar 103 downwards (in FIG. 11, in the direction of arrow C).

When this is done, the golf club shaft G is bent such that it curves downwards (in FIG. 11, in the direction of arrow C) at the spot S where the lower side contact part 109 is in contact. At this time, the bending angle of the golf club shaft G at said spot S is adjusted depending on the amount of force with which the operator presses the base end side of the bending bar 103 downwards.

However, as shown in FIG. 11, in the event that the bending bar 103 is pressed downwards, a pressing force is generated that forces the neck spot N of the golf club shaft G forwards (in FIG. 11, in the direction of arrow D). There are then problems in that said neck spot N is bent by said pressing force, and is squished flat, or the adhesion is lost, and the club is damaged.

Accordingly, the present invention was created in light of the problems of the above-mentioned prior art, and takes as its purpose the provision of an angle adjuster for a golf club shaft, which is configured such that it is possible to bend precisely and accurately the bent part of the golf club shaft, in a state where no load is applied to the neck part of the golf club shaft.

SUMMARY OF THE INVENTION

The invention is embodied in an angle adjuster for adjusting the bending angle of the bent part of a golf club shaft. The angle adjuster may include a base, two pressing force receiving parts on the base, and a pressing part on the base that can advance and retreat towards the space between the pressing force receiving parts. Receiving grooves with which the golf club shaft is in contact may be formed on the above-mentioned pressing force receiving parts. Bending force is applied to the bent portion of the shaft between the two pressing force receiving parts while the shaft is brought into contact with the receiving grooves.

Because the device is configured such that pressing force is applied to the bent part of the shaft by the pressing part, between the pressing force receiving parts, while both sides of the bent part of the golf club shaft are received by each pressing force receiving part, said bent part can be bent accurately at the spot where-it is in contact with the pressing part, and it is possible to control accurately the spot where said bent part bends.

DESCRIPTION OF PREFERRED EMBODIMENTS

Figure 1:
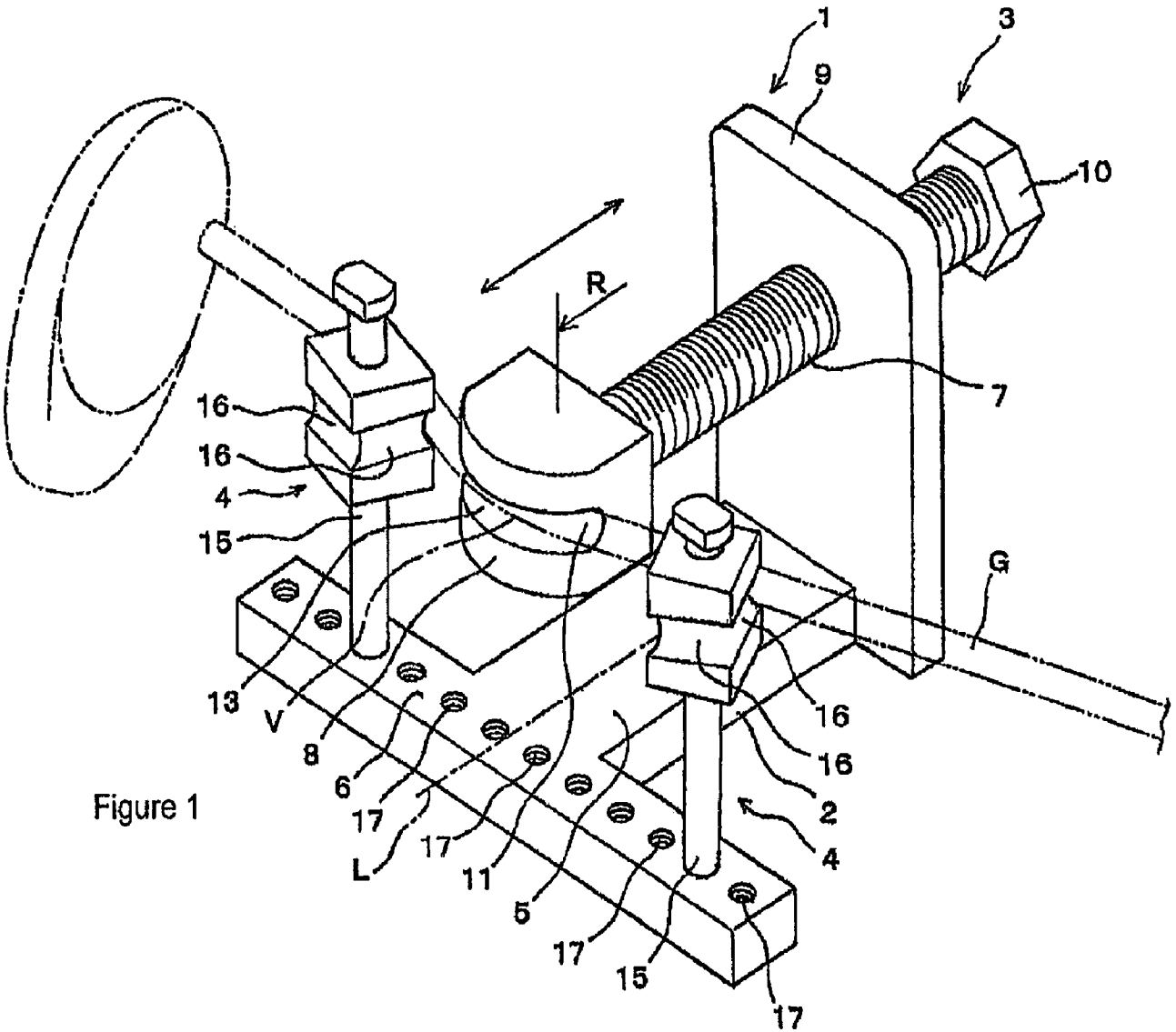
FIG. 1 is an oblique view of an angle adjuster for a golf club shaft according to a first embodiment of the present invention.

FIGS. 1 to 8 illustrate a first embodiment of an angle adjuster for a gold club shaft.

Said angle adjuster 1 includes a base 2 made of steel, a pressing part 3 provided such that it stands on said base 2, and two pressing force receiving parts 4. The device is configured so that it is possible to dispose the golf club shaft G between the pressing part 3 and the two pressing force receiving parts 4.

The base 2 is an element on which the pressing part 3 and the two pressing force receiving parts 4 are disposed. There are no restrictions on its shape, but as in the embodiment shown in FIG. 1 the whole can be configured compactly in a T-shape, with the pressing part 3 at a position corresponding to the lower end of said letter T, and the pressing force receiving parts provided in positions corresponding to both upper ends of the T. The base 2 may for example include a rectangular solid-shaped base main body 5 and an extended part on the front tip of said base main body 5 such that it extends in a direction that is orthogonal to the shaft core L of said base main body 5, and when it is viewed from above, it is possible to form it in a shape that makes a T-shape. Said base 2 is formed with a thickness that allows an operator to grip it, and can be configured such that the operator can carry it.

The pressing part 3 is provided on the base 2 such that it can freely advance and retreat in the front and rear directions (in the figure, in the direction of the arrow). So long as said pressing part 3 can advance and retreat in the front and rear directions, its structure is not restricted. The pressing part 3 can for example include as shown in FIG. 1 a rotating shaft 7 on which a male screw is threaded and a part that is pressed into contact 8 that is provided on the front tip of said rotating shaft 7. Said rotating shaft 7 is supported rotatably on a screw hole of a support part 9 that stands on the rear end of the base main body 5. The rotating shaft can thus advance or retreat forwards or backwards due to the rotation in the clockwise direction and the rotation in the counterclockwise direction. By providing a hexagonal columnar operating part 10 on the base end of said rotating shaft 7, it can be configured such that the rotating shaft 7 can be rotated and operated easily. The rotating shaft 7 can be provided such that it can advance or retreat forwards and backwards along the shaft core L of the above-mentioned base main body 5. Said pressing part 3 is formed such that it can advance further to the front than the position of said extension part 6.

Figure 2:
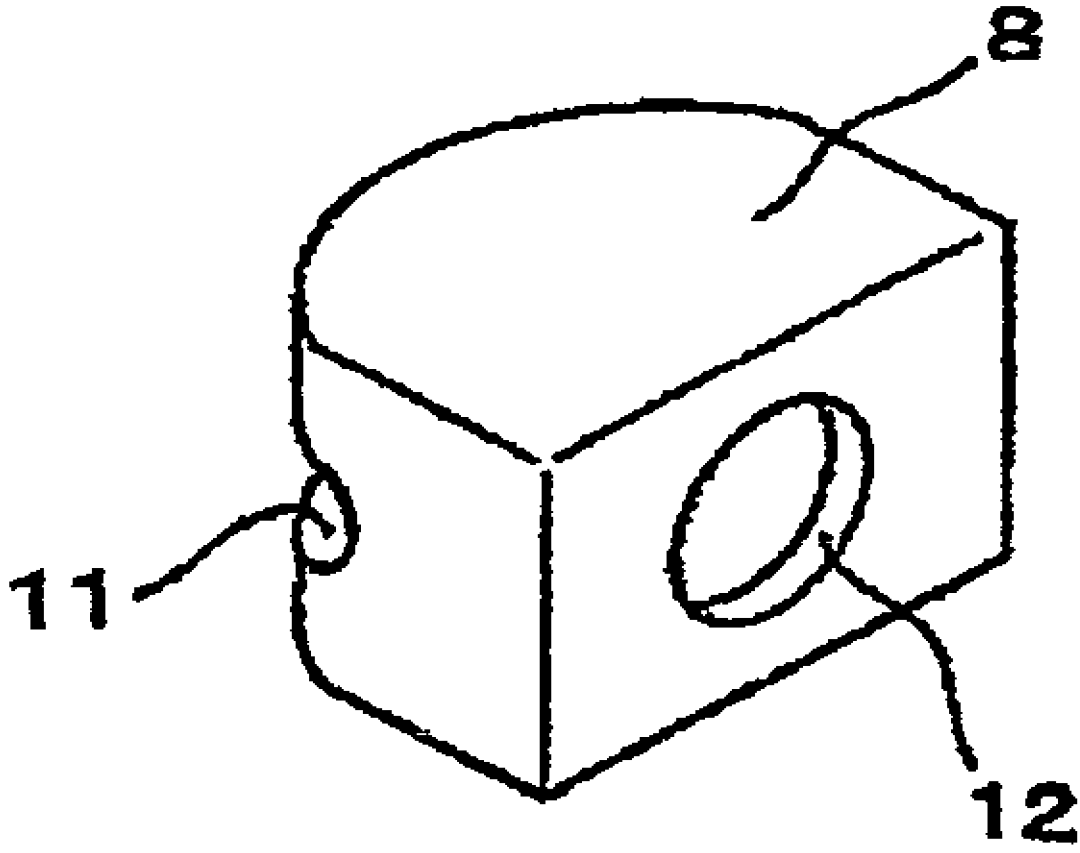
FIG. 2 is an oblique view of a pressing contact part included in FIG. 1, but viewed from its back surface side.

A pressing surface 11 is formed on the surface of the pressing contact part 8, and as shown in FIG. 2, a mating indentation 12 is formed on the back surface. As shown in FIG. 1, said pressing surface 11 has a shape that makes it possible to apply pressing force in contact with the bent part V of the golf club shaft G when said golf club shaft is laid on its side. A plurality of these have been prepared in accordance with the shape of said bent part V and the orientation that is in contact with said bent part V. In this manner, a plurality of pressing contact parts 8 have been prepared, and are configured such that the mating indentation 12 on the back surface mates to the front tip of the above-mentioned rotating shaft 7, and it is possible to replace these as needed.

Figure 3:
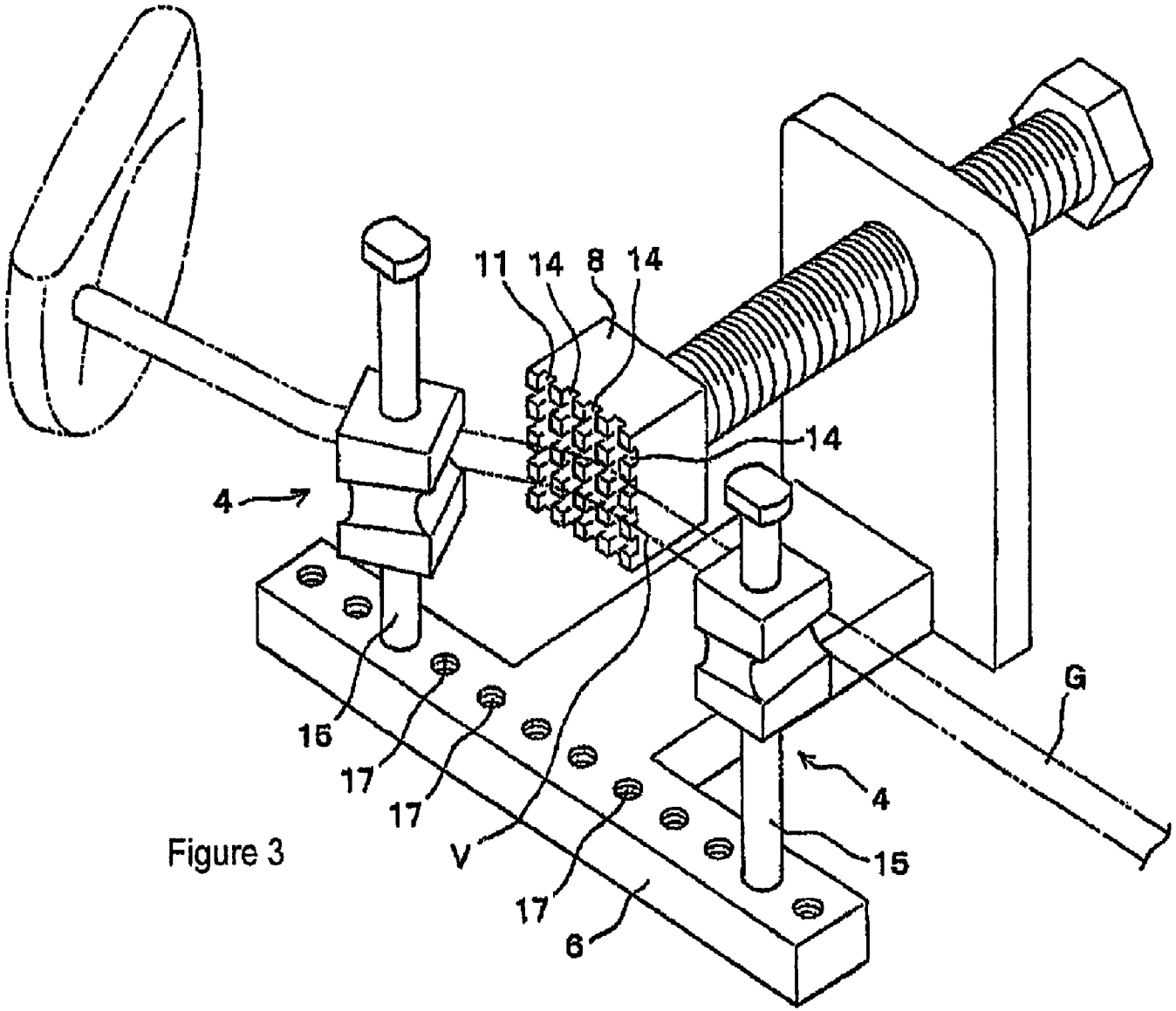
FIG. 3 is an oblique view of an angle adjuster for a golf club shaft with a pressing contact part that is different from that of FIGS. 1 and 2.

FIG. 1 illustrates a case in which the pressing contact parts 8 are formed in shape that can be in contact from the side on which the bent part V is indented, and FIG. 3 shows a case where the pressing contact parts 8 are formed in shape that can be in contact from the side on which the bent part V protrudes.

A curved groove 13 to which the bent part V of the golf club shaft G is mated is formed on the surface of the pressing contact parts 8 shown in FIG. 1. Said curved groove 13 has a groove width to which said bent part V is mated, and moreover it is curved in a shape that corresponds to the bending of said bent part V such that said bent part V mates with it. In this manner, when the curved groove 13 is formed on the surface of the pressing contact parts 8, the above-mentioned pressing surface 11 is formed by the groove bottom surface of said curved groove 13.

As for the pressing contact parts 8 shown in FIG. 1, it is possible to adjust the angle of the bent part V in a range of approximately 2 degrees to 6 degrees by employing pressing contact parts 8 whose radius of curvature of the groove bottom surface is from 30 mm to 50 mm. In particular, when pressing contact parts 8 of 30 mm and 50 mm are assembled and used, even an operator with a low learning level who is unaccustomed to the operation can effectively prevent without relying on his intuition the golf club shaft G from bending too much at one go and said golf club shaft G from being broken or damaged, owning to the fact that after the golf club shaft G is bent and deformed weakly by the 50 mm member the golf club G shaft is bent and deformed more strongly locally with the 30 mm member.

Figure 4:
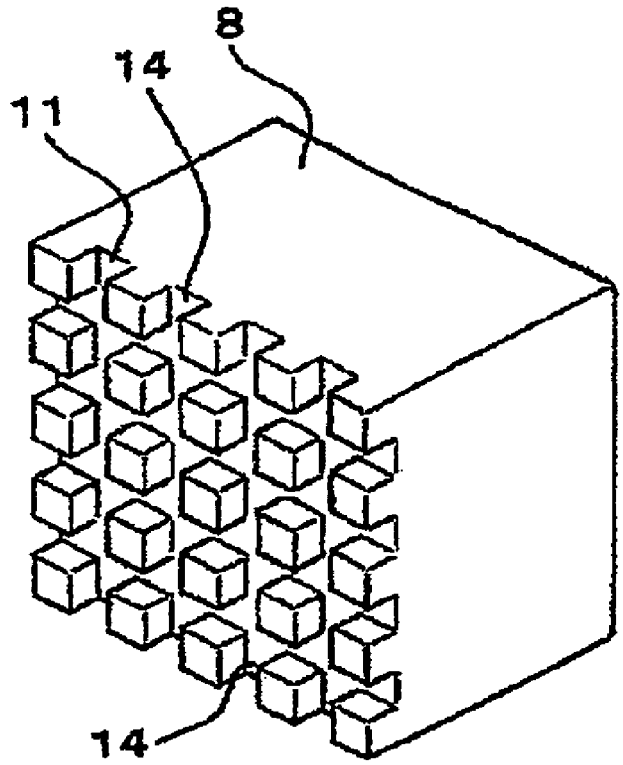
FIG. 4 is an oblique view in which the pressing contact part of FIG. 3 is viewed from its front surface side.
Figure 5:
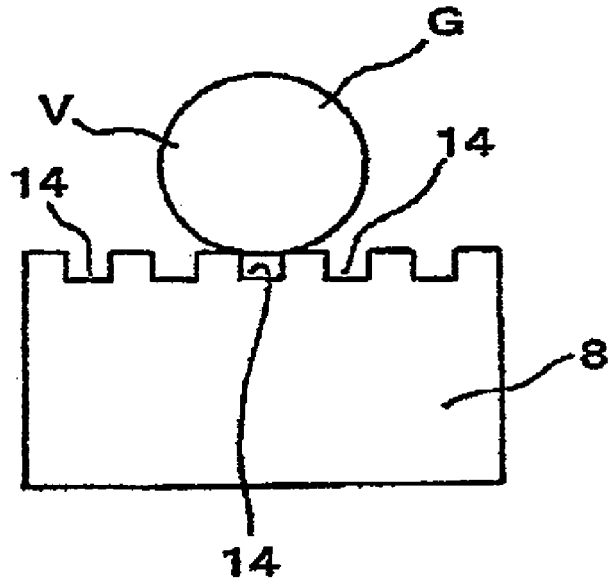
FIG. 5 is a partial side view of a state in which the golf club shaft is in contact with the surface of the pressing contact part of FIGS. 3 and 4.

A flat pressing surface 11 is formed on the surface of the pressing contact part 8 shown in FIG. 3. Grooves 14 to which a portion of the golf club shaft G is mated are formed on said pressing surface 11. Just one of said grooves 14 is adequate, or, they may be formed in the shape of a cross by forming them vertically and horizontally, and in addition they may be formed in a lattice shape by providing a plurality of said grooves 14 vertically and horizontally. In addition, it is preferable that the groove width of the above-mentioned grooves 14 is between 1 mm and 3 mm, and in particular grooves with a groove width of 2 mm and for which each of a plurality of pressing surfaces 11 that are formed by these grooves have 4 mm widths are optimal. FIG. 4 shows an oblique view of said pressing contact part 8, and FIG. 5 shows a state where the bent part V of the golf club shaft is received by the grooves 14 of said pressing contact part 8.

It is preferable that the above-mentioned pressing contact part 8 is formed with a member made of softer material than the material of said golf club shaft G, such that it can conform to the shape of said golf club shaft G. Said pressing contact part 8 can be formed with Urethane (registered trademark), Teflon (registered trademark), wood, etc. whose shore hardness is 90 and above.

As shown in FIG. 1 and FIG. 3, the above-mentioned pressing force receiving part 4 is provided on the above-mentioned extension part 6. Two of said pressing force receiving parts 4 are provided, and these two pressing force receiving parts 4 are provided with a space between them such that the front tip of the above-mentioned pressing part 3 can advance and reach the intermediate position thereof.

In addition, the above-mentioned pressure receiving-parts 4 are formed by a hexahedron, and pins 15 are provided by configuring it such that they pass through the upper and lower surfaces. Then, it is configured such that it is possible to adjust the approach and coming between of said pressing force receiving part 4 to the base 2 owing to the fact that the pins 15 move in an axial direction, and it is possible to carry out accurately the bending operation of said golf club shaft G, in accordance with the amount of bending, the bending direction, etc., of said golf club shaft G, so it is configured such that height adjustment of said pins 15 in the axial direction is possible, and it is configured such that it can be rotated with said pins 15 at the center. Receiving grooves 16 are formed at each of the four side surfaces of said pressing force receiving parts 4. As shown in FIG. 1 and FIG. 3, said receiving grooves 16 are grooves to which the golf club shaft G is mated and received when said golf club shaft G is laid on its side.

Figure 6:
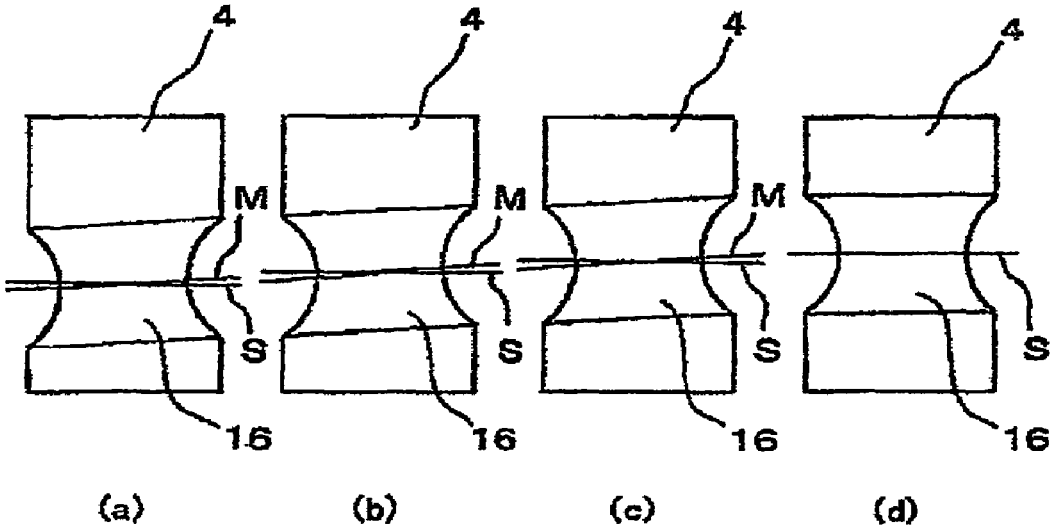
FIG. 6 is a side view showing side surfaces of pressing force receiving parts of FIGS. 1 and 3.

As shown in FIG. 6, the inclinations of the shaft cores M of the receiving grooves provided on each side surface of the above-mentioned pressing force receiving parts 4 are made different from one another, with the horizontal line S as the reference. That is, FIGS. 6(*a*), (*b*) and (*c*) illustrate cases in which said shaft cores M are formed such that they incline in the counterclockwise direction with the horizontal line S as the reference, and show cases where the formation positions of the receiving grooves 16 provided on each pressing force receiving part 4 are made different in the up and down direction, and FIG. 6(*d*) shows a case where said shaft core M is more or less aligned with the horizontal line S.

Figure 7:
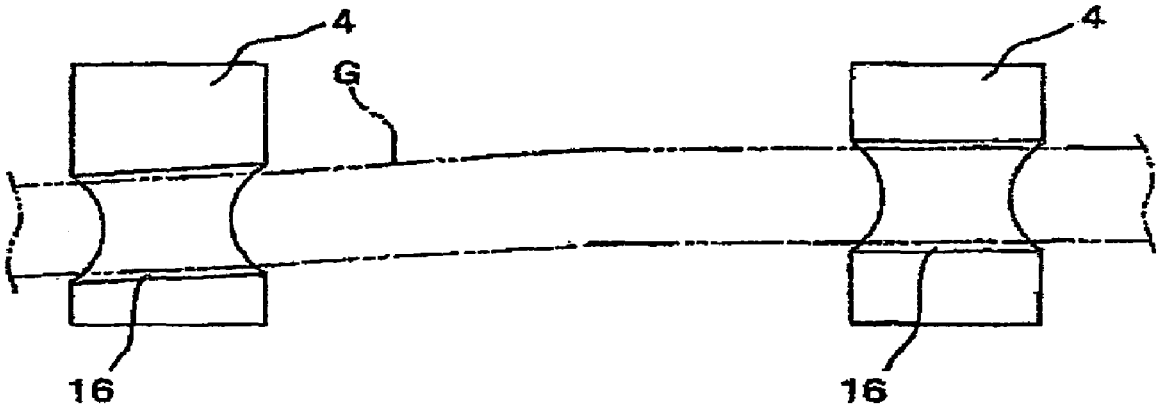
FIG. 7 is a figure showing a state in which the golf club shaft is received by the pressing force receiving parts.

In FIG. 7, the state shown in FIG. 6(*a*) is selected for the inclination of the receiving groove 16 of the pressing force receiving part 4 on one side, and the state shown in FIG. 6(*d*) is selected for the inclination of the receiving groove 16 of the pressing force receiving part 4 on the other side In the case shown in FIG. 7, the angle of the loft angle direction is set such that the golf club shaft 2 is received by the two pressing force receiving parts 4. FIG. 7 shows a state in which the two pressing force receiving parts 4 are viewed from the pressing part 3 side.

In addition, as shown in FIG. 1 and FIG. 3, a plurality of pin holes 17 in which the pins 15 of the above-mentioned pressing force receiving parts 4 are screwed are provided, and two pin holes 17 are selected optionally from this plurality of pin holes 17. Position adjustment of the two pressing force receiving parts 4 is done by inserting the pins 15 of these two pressing force receiving parts 4. A plurality of these pin holes 17 is provided at equal intervals, for example 24 mm intervals, on the left and right with the shaft core L of the base main body 5 as the center. Therefore, it is possible to adjust accurately the position of the deformation and amount of deformation applied to the golf club shaft G, by selecting appropriately the interval of the pressing force receiving parts 4.

Next, a description is provided of a procedure for adjusting the angle in the lie angle direction of the golf club shaft G. Here, the angle in the loft angle direction of the golf club shaft G has already been adjusted. In FIG. 1, receiving grooves 16 are selected that can receive the golf club shaft as the pressing force receiving part 4 is rotated, and aligned with the bending in said loft angle direction, when the golf club shaft G is laid on its side. FIG. 1 and FIG. 7 show the state where the golf club shaft G is set.

Next, the operating part 10 of the pressing part 4 is operated, the rotating shaft 7 is advanced, the pressing contact parts 8 are brought close to the bent part V of the golf club shaft G, and said bent part V is mated to the curved grooves 13 of said pressing contact parts 8.

After that, the pressing contact parts 8 are brought close to the bent part V of the golf club shaft G and pressing force is applied to said bent part V by operating the operating part 10. As for the golf club shaft G, the bent part V is bent and angle adjustment of said bent part V is performed such that the angle of said bent part V becomes smaller still, owing to the fact that said bent part V is pressed by the pressing part 3 in a state where both sides of said bent part are received by the pressing force receiving part 4.

In this case, as shown in FIG. 1 and FIG. 3, the golf club shaft G can bend at the spot at which the pressing part is in contact and pressing force is applied, so the operator can specify accurately the spot at which the golf club shaft G bends.

In addition, the golf club shaft G has not been gripped in a state in which the pressing force receiving parts 4 are in contact. In addition, the above-mentioned pressing contact parts 8 are formed with a member made of a material softer than the golf club shaft G, so when the bent part V is pressed with the pressing contact parts 8, it is possible to apply bending force to said bent part V while the pressing contact parts 8 are deformed into a shape such that they conform to the shape of said bent part V, by the reactive force from said bent part V.

Moreover, the pressing force receiving parts 4 can rotate with the pins I 5 as the center, and in addition can move freely in the axial direction of said pins 15, that is, in the height direction. Owing to this, when the bent part V of the golf club shaft G is deformed while being pressed by the pressing part 3, along with said deformation said pressing force receiving parts 4 move in the axial direction and circumferential direction of the pins 15 and continue to change posture, and can receive said bent part V while fitting to the shape of said bent part V. In particular, since the extent of the deformation of the bent part V differs depending on the shape, hardness and angle of the golf club shaft G, as noted above, the fact that the pressing force receiving parts 4 can follow the shape of said bent part V and change its posture is extremely desirable from the standpoint of adjusting precisely the bending angle of the bent part V. In addition, since it is possible to support comfortably the bent part V while the pressing force receiving parts 4 follow the shape of said bent part V and changes its posture, it is possible to hold in check the damage to the golf club G.

Figure 8:
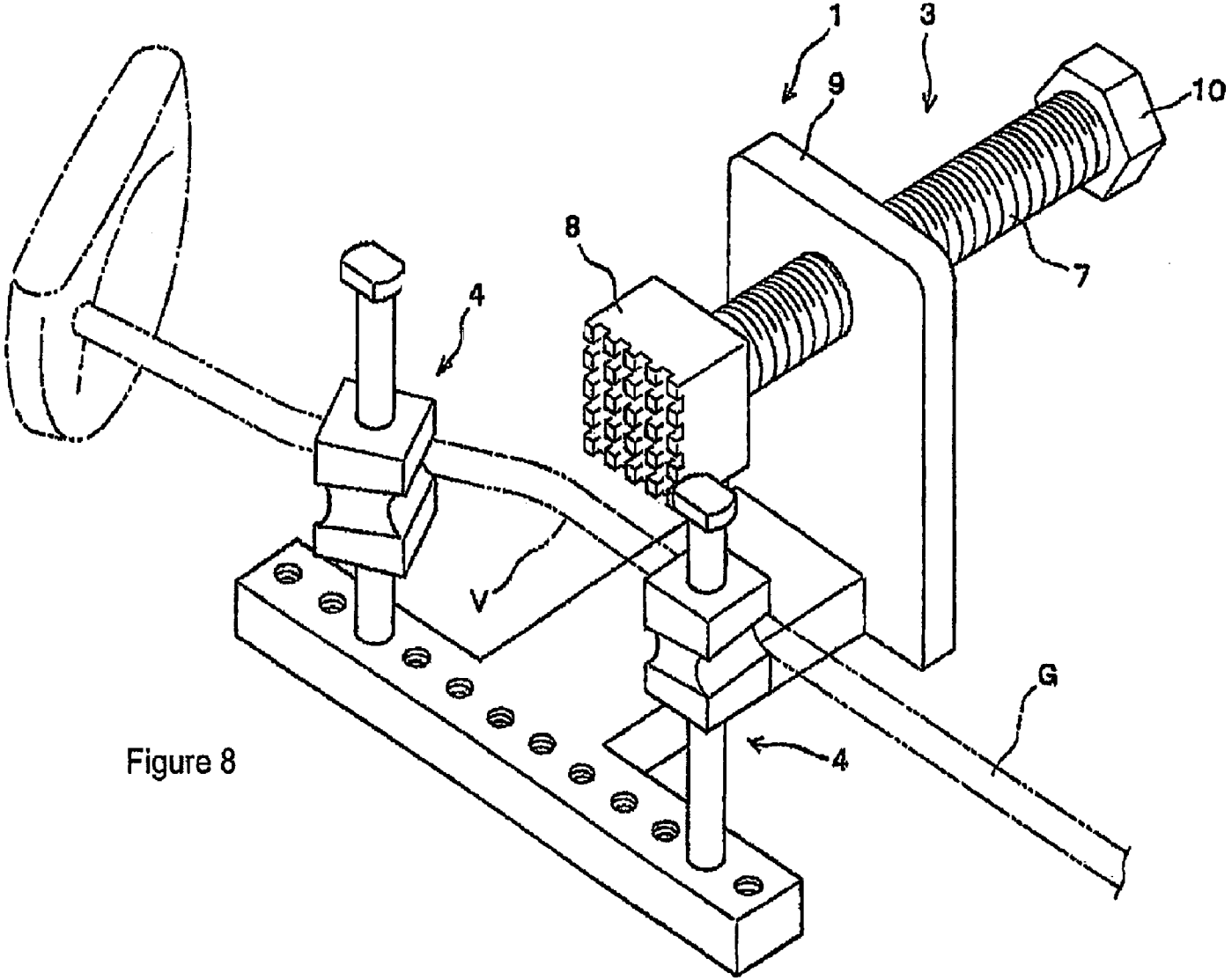
FIG. 8 is an oblique view of the angle adjuster for a golf club shaft shown in FIG. 3, but with a golf club received in the device in a position different from that of FIG. 3.

In a case where angle adjustment is done such that the angle of the above-mentioned bent part V is increased, that is, where the bending is reduced, it changes from the state shown in FIG. 1 to the state shown in FIG. 8, owing to the fact that the operating part 10 is operated and the rotating axis 7 is caused to retreat, after which the pressing contact part 8 is removed, while it is replaced with a new pressing contact part 8. FIG. 8 shows a state in which the golf club shaft G is set such that the protruding side of the bent part V of the golf club shaft G is opposed to the pressing contact part S. Then, in the state shown in FIG. 8, by operating the operating part 10 of the pressing part 3, and advancing the rotating shaft 7, the bent part C is pressed by the pressing contact part S. In this case, angle adjustment is done for the bent part V such that the angle of the bent part V becomes larger, that is, such that the degree of bending of the bent part V becomes smaller, by bending in the opposite direction from that in the case shown in FIG. 1.

In the above description, a description was provided of a case where the angle of the lie angle is adjusted, but as shown in FIG. 1 or FIG. 3, it is also possible to adjust the loft angle or any optional angle other than this by altering the posture in which the golf club shaft G is set on the pressing force receiving parts 4.

The angle adjuster 1 of the golf club shaft in this application is not limited to the above-mentioned embodiment, and it is for example possible to operate the operating part 10 easily without employing a spanner, provided that for example the shape of the operating part 10 is formed in the shape of a handle with a T-shape or a cross shape. In addition, it goes without saying that the shapes, materials sizes, etc., of the base 2, pressing part 3, pressing force receiving part 4, rotating shaft 7, pressing contact part 8, pressing surface 11 and receiving groove 16 can be altered as appropriate.

In addition, it is preferable to configure the device such that a golf club shaft G with various bending angles can be supported comfortably by the receiving grooves 16, by equipping it with a plurality of pressing force receiving parts 4 whose number is greater than pin holes 17 that are provided on the above-mentioned extension part 6, and by preparing a plurality thereof with inclination angles of the receiving grooves 16, which are provided on each of the pressing force receiving parts 4, from large to small, and by selecting pressing force receiving parts 4 equipped with receiving grooves 16 with optional inclination angles as appropriate and inserting these in the pin holes 17 and assembling them.

Moreover, it is possible to raise the durability of the rotating axis 7 and supporting part 9 of the above-mentioned pressing part 3 by forming the rotating axis 7 and supporting part 9 with stainless steel, or forming the screws of said rotating axis 7 and supporting part 9 with square screws or trapezoid screws.

In addition, the device may be made such that said pressing part 3 includes a rack and pinion, the rotation of the pinion is converted into the forward and rear movement of the rack, and a pressing contact part 8 is provided on said rack.

Figure 9:
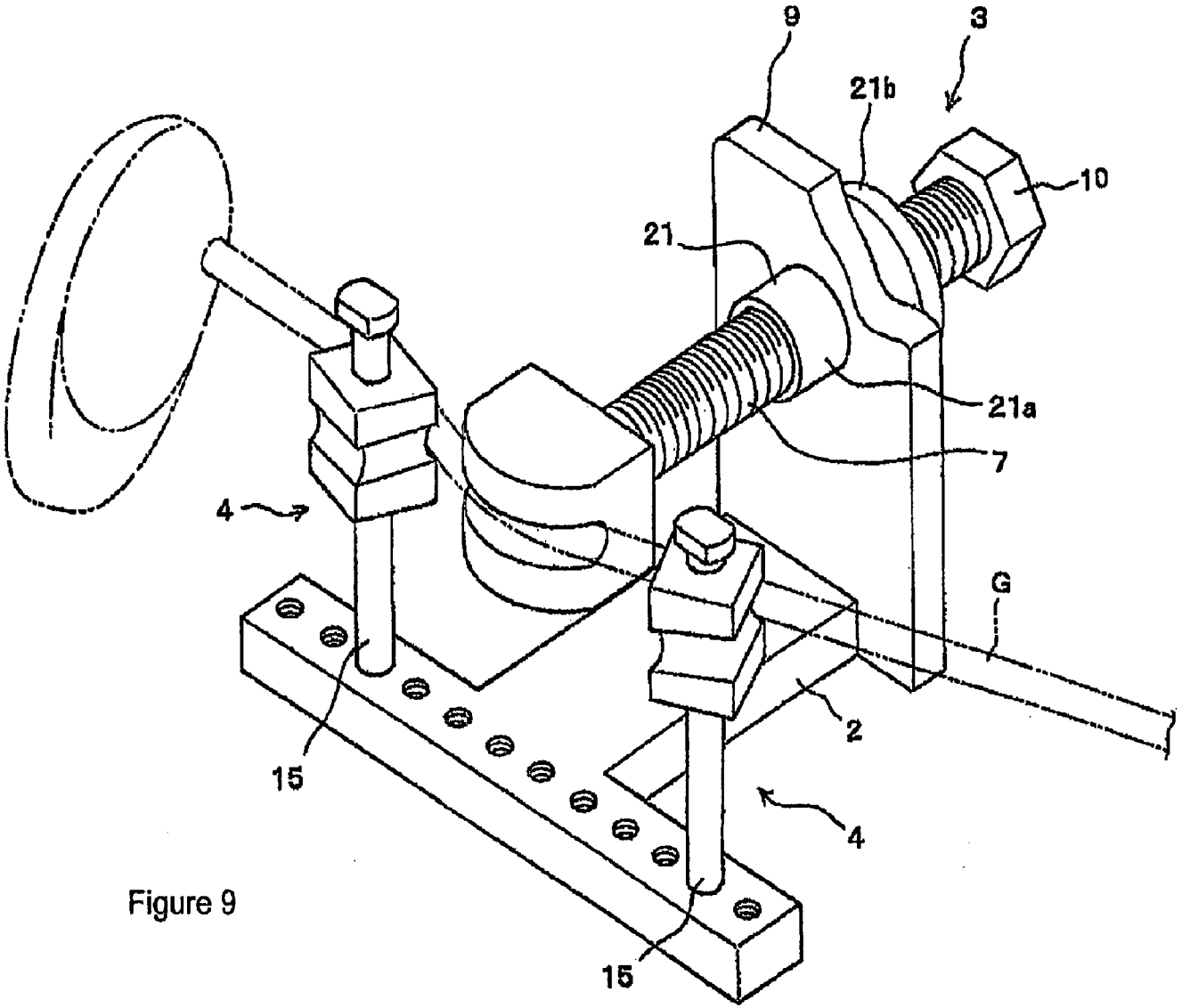
FIG. 9 is an oblique view of an angle adjuster for a golf club shaft according to an alternative embodiment.
Figure 10:
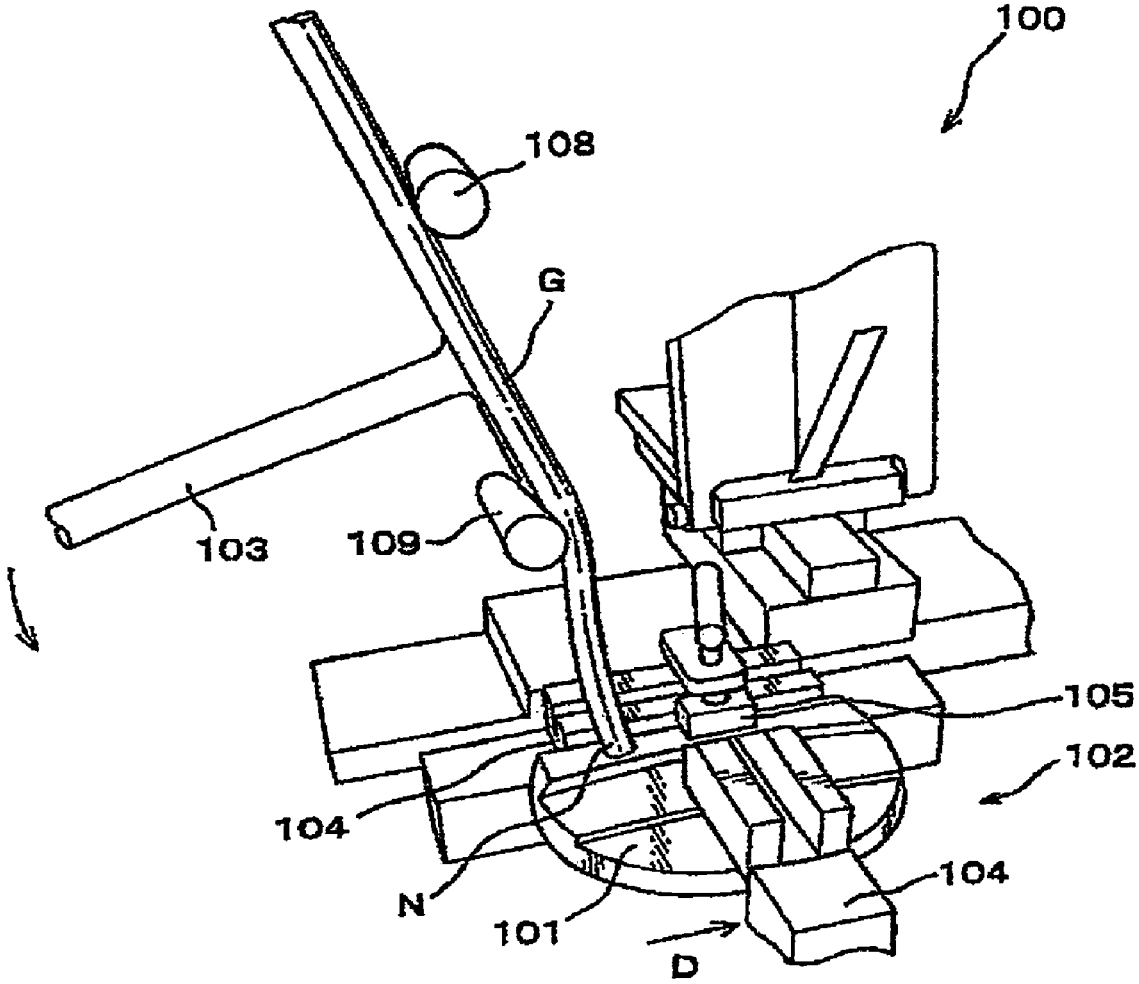
Figure 10 (Prior Art)
FIG. 10 is an oblique view showing a conventional angle adjuster.
Figure 11:
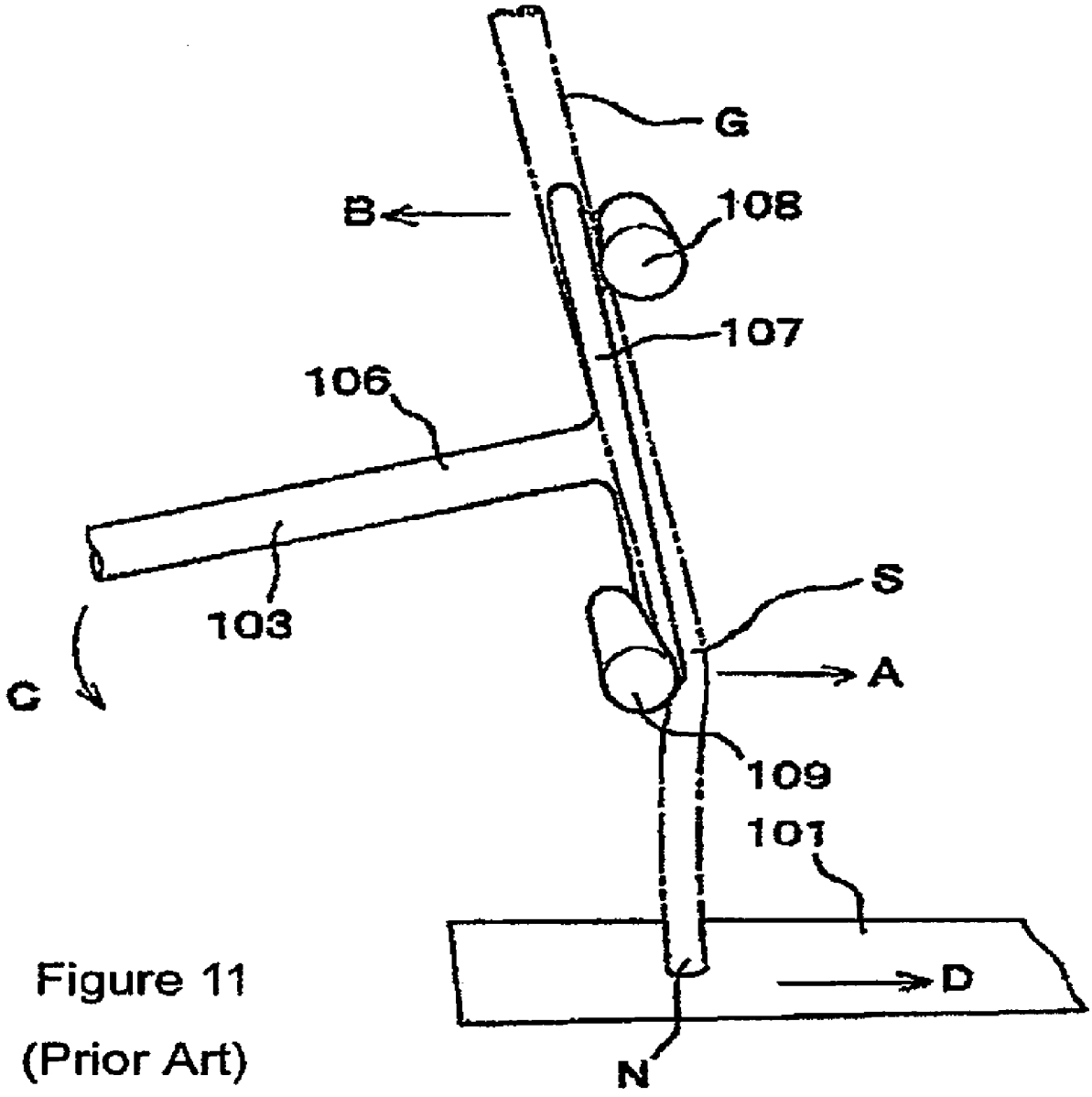
Figure 11 (Prior Art)
FIG. 11 an enlarged view of part of the device of FIG. 10.

FIG. 9 shows a second embodiment. In the second embodiment a shaft bearing 21 is provided on the support part 9, such that the rotating shaft 7 is supported by said shaft bearing 21. Said shaft bearing 21 can be composed of a cylindrical small bore part 21*a* and large bore part 21*b*. It may be configured such that screw holes are formed on said shaft bearing 21, and the rotating shaft 7 is screwed to into said screw holes. Then, by configuring it such that a shaft hole on which the small bore part 21*a* is provided on a support part 9 is pierced through, and the large bore part 21*b* is in contact with the reverse surface of the support part 9, said shaft bearing 21 is provided on the support part 9 as shown in FIG. 9.

The shaft bearing may be made with a material with a thermal expansibility that is greater than the thermal expansibility of the rotating shaft 7, such that the above-mentioned rotating shaft 7 is made with iron or an alloy thereof, and moreover the above-mentioned shaft bearing 21 is made with brass. When materials are selected in this manner, the following effects are obtained based on the fact that the thermal expansibility of brass is greater than that of iron. In other words, in the event that the rotating shaft 7 and shaft bearing 21 emit heat owing to the repeated operation of said rotating shaft 7, the rotating shaft 7 expands thermally due to said heat emission, but this is greater than the volumetric expansion of said rotating shaft 7, and the screw holes of the shaft bearing 21 end up enlarging, and the clearance between the male screws of the rotating shaft 7 and the screw holes of the shaft bearing is ensured. Owing to this, even under conditions where the rotating shaft 7 is operated repeatedly, the smooth operation of the rotating shaft 7 is ensured.

The invention claimed is:

1. An angle adjuster operable to adjust a bending angle of a bent part of a golf club shaft, the angle adjuster comprising:

a base;

two pressing force receiving parts mounted on the base, the two pressing force receiving parts being spaced apart with an intermediate space between them, wherein each of the two pressing force receiving parts is mounted on the base with structure that allows the pressing force receiving part to turn about an axis, and wherein each of the pressing force receiving parts includes structure defining an elongate groove configured to receive a portion of the golf club shaft, and wherein a length of that groove is out of parallel with a plane perpendicular to the axis about which that pressing force receiving part can rotate;

a first pressing part mounted on the base; and an advancement mechanism operable to advance the first pressing part from a first position outside of the intermediate space between the two pressing force receiving parts to a second position inside the intermediate space between the two pressing force receiving parts and in contact with the golf club shaft received within the grooves of the two pressing force receiving parts.

2. The angle adjuster of claim 1, and further comprising:

a support part mounted on the base;

wherein the advancement mechanism includes a screw mechanism mounted on the support part, wherein the screw mechanism is threaded and operable to advance the first pressing part from the first position to the second position when the screw mechanism is rotated with respect to the support part.

3. The angle adjuster of claim 1, wherein each of the two pressing force receiving parts includes at least two faces, wherein each of the at least two faces of each pressing force receiving part includes structure defining an elongate groove, and wherein a length of at least one of the grooves on each of the two pressing farce receiving parts is out of parallel with the plane perpendicular to the axis about which that pressing force receiving part can rotate.

4. The angle adjuster of claim 1, wherein each of the two pressing force receiving parts is mounted on the base via a pin, and wherein each of the two pressing force receiving parts is movable along the length of its pin.

5. The angle adjuster of claim 4, and further comprising structure on the base defining a plurality of spaced apart pin receiving holes, wherein the intermediate space between the two pressing force receiving parts is adjustable by the movement of each of the pins into a different selected one of the pin receiving holes.

6. The angle adjuster of claim 1, and further comprising a second pressing part interchangeable with the first pressing part on the advancement mechanism, wherein the first pressing part has a curved pressing surface configured for contact with the golf club shaft, and wherein the second pressing part has a grooved pressing surface comprising structure defining grooves in an otherwise generally planar surface configured for contact with the golf club shaft.

7. An angle adjuster operable to adjust a bending angle of a bent part of a golf club shaft, the angle adjuster comprising:

a base;

two pressing force receiving parts mounted on the base and configured to bear against the golf club shaft, the two pressing force receiving parts being spaced apart with an intermediate space between them, wherein each of the two pressing force receiving parts is mounted on the base via a pin and wherein each of the two pressing force receiving parts is movable along a length of that pin;

a first pressing part mounted on the base; and an advancement mechanism operable to advance the first pressing part from a first position outside of the intermediate space between the two pressing force receiving parts to a second position inside the intermediate space between the two pressing force receiving parts and in contact with the golf club shaft bearing against the two pressing force receiving parts.

8. The angle adjuster of claim 7, and further comprising:

a support part mounted on the base;

wherein the advancement mechanism includes a screw mechanism mounted on the support part, wherein the screw mechanism is threaded and operable to advance the first pressing part from the first position to the second position when the screw mechanism is rotated with respect to the support part.

9. The angle adjuster of claim 7, wherein each of the pressing force receiving parts includes structure defining an elongate groove configured to receive a portion of the golf club shaft, and wherein a length of that groove is out of parallel with a plane perpendicular to the length of its pin.

10. The angle adjuster of claim 9. wherein each of the two pressing force receiving parts includes at least two faces, wherein each of the at least two faces of each pressing force receiving part includes structure defining an elongate groove, and wherein a length of at least one of the grooves on each of the two pressing force receiving parts is out of parallel with the plane perpendicular to the length of its pin.

11. The angle adjuster of claim 7, and further comprising structure on the base defining a plurality of spaced apart pin receiving holes, wherein the intermediate space between the two pressing force receiving parts is adjustable by the movement of each of the pins into a different selected one of the pin receiving holes.

12. The angle adjuster of claim 7, and further comprising a second pressing part interchangeable with the first pressing part on the advancement mechanism, wherein the first pressing part has a curved pressing surface configured for contact with the golf club shaft, and wherein the second pressing part has a grooved pressing surface comprising structure defining grooves in an otherwise generally planar surface configured for contact with the golf club shaft.

13. An angle adjuster operable to adjust a bending angle of a bent part of a golf club shaft, the angle adjuster comprising:

a base;

two pressing force receiving pans mounted on the base and configured to bear against the golf club shaft, the two pressing force receiving pans being spaced apart with an intermediate space between them;

structure on the base defining a plurality of spaced apart pin receiving holes, wherein each of the two pressing force receiving parts is mounted on the base via a movable pin, and wherein the intermediate space between the two pressing force receiving pans is adjustable by the placement of each of the movable pins into a different selected one of the pin receiving holes, and wherein each of the two pressing force receiving pans is movable along a length of its pin;

a first pressing part mounted on the base; and an advancement mechanism operable to advance the first pressing pan from a first position outside of the intermediate space between the two pressing force receiving parts to a second position inside the intermediate space between the two pressing force receiving pans and in contact with the golf club shaft bearing against the two pressing force receiving parts.

14. The angle adjuster of claim 13, and further comprising:

a support part mounted on the base;

wherein the advancement mechanism includes a screw mechanism mounted on the support pan, wherein the screw mechanism is threaded, and operable to advance the first pressing part from the first position to the second position when the screw mechanism is rotated with respect to the support part.

15. The angle adjuster of claim 13, wherein each of the pressing force receiving parts includes structure defining an elongate groove configured to receive a portion of the golf club shaft, and wherein a length of that groove is out of parallel with a plane perpendicular to a length of its pin.

16. The angle adjuster of claim 15, wherein each of the two pressing force receiving parts includes at least two faces, wherein each of the at least two faces of each pressing force receiving part includes structure defining an elongate groove, and wherein a length of at least one of the grooves on each of the two pressing force receiving parts is out of parallel with the plane perpendicular to the length of its pin.

17. The angle adjuster of claim 13, and further comprising a second pressing part interchangeable with the first pressing part on the advancement mechanism, wherein the first pressing part has a curved pressing surface configured for contact with the golf club shaft, and wherein the second pressing part has a grooved pressing surface comprising structure defining grooves in an otherwise generally planar surface configured for contact with the golf club shaft.

* * * * *